US012529483B2

(12) United States Patent
Luo et al.

(10) Patent No.: US 12,529,483 B2
(45) Date of Patent: Jan. 20, 2026

(54) SADDLE WINDOW AIR CONDITIONER WITH AN ADJUSTABLE BRIDGE

(71) Applicant: Haier US Appliance Solutions, Inc., Wilmington, DE (US)

(72) Inventors: Qiang Luo, Shanghai (CN); Jian Cui, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 765 days.

(21) Appl. No.: 17/796,973

(22) PCT Filed: Jul. 22, 2022

(86) PCT No.: PCT/CN2022/107310

§ 371 (c)(1),
(2) Date: Jan. 25, 2024

(87) PCT Pub. No.: WO2024/016310

PCT Pub. Date: Jan. 25, 2024

(65) Prior Publication Data

US 2024/0191885 A1 Jun. 13, 2024

(51) Int. Cl.
*F24F 1/027* (2019.01)
*F24F 13/20* (2006.01)

(52) U.S. Cl.
CPC ..... *F24F 1/027* (2013.01); *F24F 13/20* (2013.01)

(58) Field of Classification Search
CPC ..... F24F 1/027; F24F 1/031; F24F 13/20
See application file for complete search history.

(56) References Cited

U.S. PATENT DOCUMENTS 3,176,474 A * 4/1965 Abbott ..... F24F 1/0003 62/262
5,167,131 A * 12/1992 Karkhanis ..... F24F 1/027 62/262
5,313,806 A * 5/1994 Feng ..... F25D 23/006 62/262
7,121,105 B1 * 10/2006 Rais ..... F24F 1/027 62/262
10,739,018 B2 * 8/2020 Baumann ..... F24F 13/32
11,498,163 B2 * 11/2022 Li ..... F24F 1/029
(Continued)

FOREIGN PATENT DOCUMENTS

CN 101876466 A * 11/2010
CN 110274316 A * 9/2019 ..... E06B 7/28
(Continued)

OTHER PUBLICATIONS

Copy of International Search Report Corresponding to Application No. PCT/CN2022107310 on Dec. 21, 2022.

*Primary Examiner* — Emmanuel E Duke
(74) *Attorney, Agent, or Firm* — Dority & Manning, P.A.

(57) ABSTRACT

A saddle window air conditioner includes an interior casing and an exterior casing. A bridge extends between the interior casing and the exterior casing. A first sleeve of the bridge is slidably received within a second sleeve of the bridge such that a length of the bridge between the interior casing and the exterior casing is adjustable by sliding the first sleeve within the second sleeve. The saddle window air conditioner also includes a gear assembly mounted within the bridge. The first sleeve is slidable within the second sleeve by rotating the gear assembly.

20 Claims, 10 Drawing Sheets

(56) References Cited

U.S. PATENT DOCUMENTS

| | | | |
|---|---|---|---|
| 2003/0097854 | A1 | 5/2003 | Cur et al. |
| 2022/0120450 | A1 | 4/2022 | Wu |

FOREIGN PATENT DOCUMENTS

| | | | | | |
|---|---|---|---|---|---|
| CN | 210320347 | U | * | 4/2020 | |
| CN | 111853956 | A | * | 10/2020 | ..... F24F 1/18 |
| CN | 111912034 | A | * | 11/2020 | ..... F24F 1/031 |
| CN | 108107856 | B | * | 12/2020 | ..... A62C 37/08 |
| CN | 212081618 | U | * | 12/2020 | |
| WO | WO-2020224328 | A1 | * | 11/2020 | ..... F24F 1/031 |

* cited by examiner

SADDLE WINDOW AIR CONDITIONER WITH AN ADJUSTABLE BRIDGE

CROSS-REFERENCE TO RELATED APPLICATIONS

The present application is the National Stage Entry of and claims the benefit of priority under 35 U.S.C. § 371 to PCT Application Serial No. PCT/CN2022/107310 filed Jul. 22, 2022 and entitled A SADDLE WINDOW AIR CONDITIONER WITH AN ADJUSTABLE BRIDGE, which is hereby incorporated by reference in its entirety for all purposes.

FIELD OF THE INVENTION

The present subject matter relates generally to saddle window air conditioners.

BACKGROUND OF THE INVENTION

Saddle window air conditioners allow a window to be freely opened and closed when the saddle window air conditioner is installed in the window. Thus, such air conditioners may be used to cool air within a home while also allowing the window to be opened to allow in fresh air. Saddle window air conditioners may further obstruct less of the window, thereby allowing more daylight to enter the room, as compared to other through-window air conditioner units. Saddle window air conditioners may also be quieter than other window air conditioners due to the placement of a fan and compressor outside of the cooled room. However, variations in a wall or window thickness that must be spanned by the saddle can make installation of saddle window air conditioners difficult.

Accordingly, saddle window air conditioner units with features for adjusting a length thereof are desired in the art.

BRIEF DESCRIPTION OF THE INVENTION

Aspects and advantages of the invention will be set forth in part in the following description, or may be apparent from the description, or may be learned through practice of the invention.

In an example embodiment, a saddle window air conditioner includes an interior casing and an exterior casing spaced from the interior casing. The saddle window air conditioner also includes a bridge extending between the interior casing and the exterior casing. The bridge includes a first sleeve mounted to one of the interior casing and the exterior casing and a second sleeve mounted to the other of the interior casing and the exterior casing. The first sleeve is slidably received within the second sleeve such that a length of the bridge between the interior casing and the exterior casing is adjustable by sliding the first sleeve within the second sleeve. The saddle window air conditioner further includes a gear assembly mounted within the bridge such that the first sleeve is slidable within the second sleeve by rotating the gear assembly.

In another example embodiment, a saddle window air conditioner includes an interior casing and an exterior casing spaced from the interior casing. The saddle window air conditioner also includes a bridge extending between the interior casing and the exterior casing. The bridge includes a first sleeve mounted to one of the interior casing and the exterior casing and a second sleeve mounted to the other of the interior casing and the exterior casing. The first sleeve is slidably received within the second sleeve such that a length of the bridge between the interior casing and the exterior casing is adjustable by sliding the first sleeve within the second sleeve. The saddle window air conditioner further includes a gear assembly coupled to the bridge such that the first sleeve is slidable within the second sleeve by rotating the gear assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
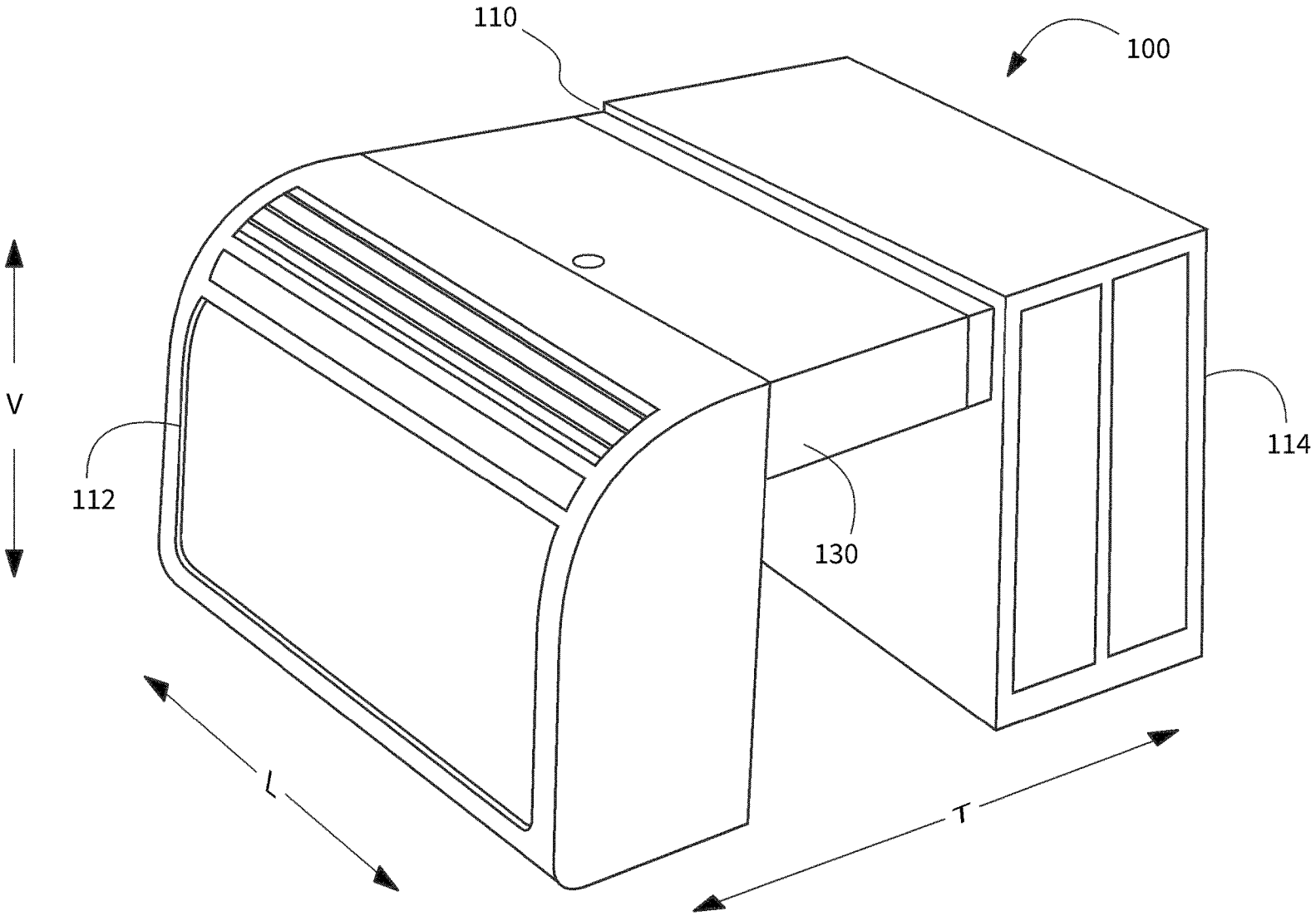
FIG. 1 is a perspective view of a saddle window air conditioner according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
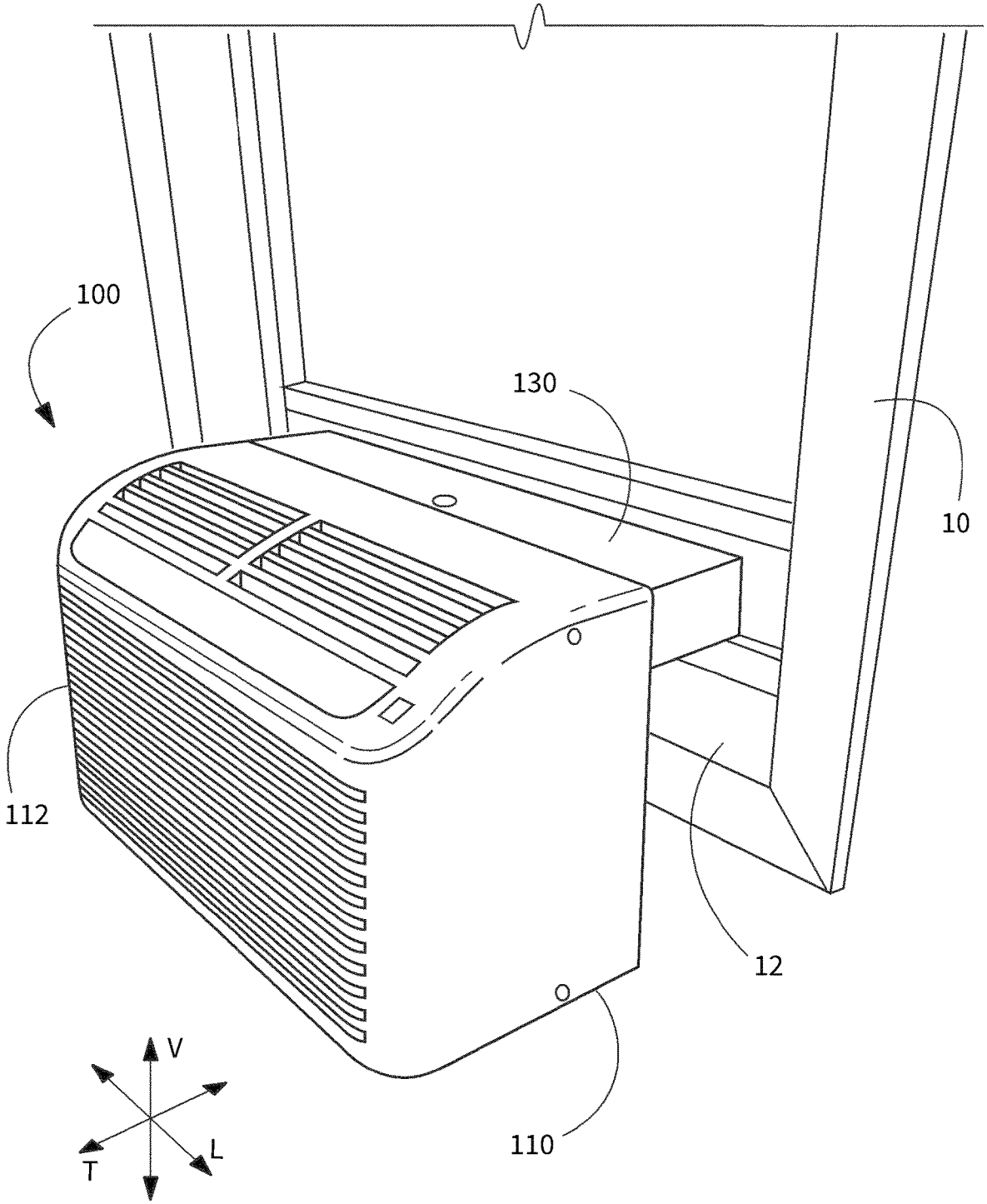
FIG. 2 is an interior perspective of the example saddle window air conditioner of FIG. 1 installed in a window.

FIG. 1 is a perspective view of a saddle window air conditioner 100 according to an example embodiment of the present subject matter. FIG. 2 is an interior perspective of saddle window air conditioner 100 installed in a window 10. Saddle window air conditioner 100 is operable to generate chilled and/or heated air in order to regulate the temperature of an associated room or building. As will be understood by those skilled in the art, saddle window air conditioner 100 may be installed within window 10 to cool and/or heat air on an interior side of window 10 to a selected temperature. As discussed in greater detail below, a sealed system 120 (FIG. 3) of saddle window air conditioner 100 is disposed within a casing assembly 110. Thus, saddle window air conditioner 100 may be a self-contained or autonomous system for heating and/or cooling air. Saddle window air conditioner 100 defines a vertical direction V, a lateral direction L and a transverse direction T that are mutually perpendicular and form an orthogonal direction system.

As used herein, the term "saddle window air conditioner" is used broadly. For example, saddle window air conditioner 100 may include a supplementary electric heater (not shown) for assisting with heating air within the associated room or building without operating the sealed system 120. However, as discussed in greater detail below, saddle window air conditioner 100 may also include a heat pump heating mode that utilizes sealed system 120, e.g., in combination with an electric resistance heater, to heat air within the associated room or building. Thus, it should be understood that "saddle window air conditioner" as used herein is intended to cover both units with and without heat pump heating modes.

With reference to FIGS. 1 and 2, casing assembly 110 includes an interior casing 112, an exterior casing 114 and a bridge 130. Interior casing 112 and exterior casing 114 are spaced apart from each other, e.g., along the transverse direction T. Thus, interior casing 112 may be positioned at or contiguous with an interior atmosphere on one side of window 10, and exterior casing 114 may be positioned at or contiguous with an exterior atmosphere on the other side of window 10. Bridge 130 extends between interior casing 112 and exterior casing 114, e.g., through window 10.

Figure 3:
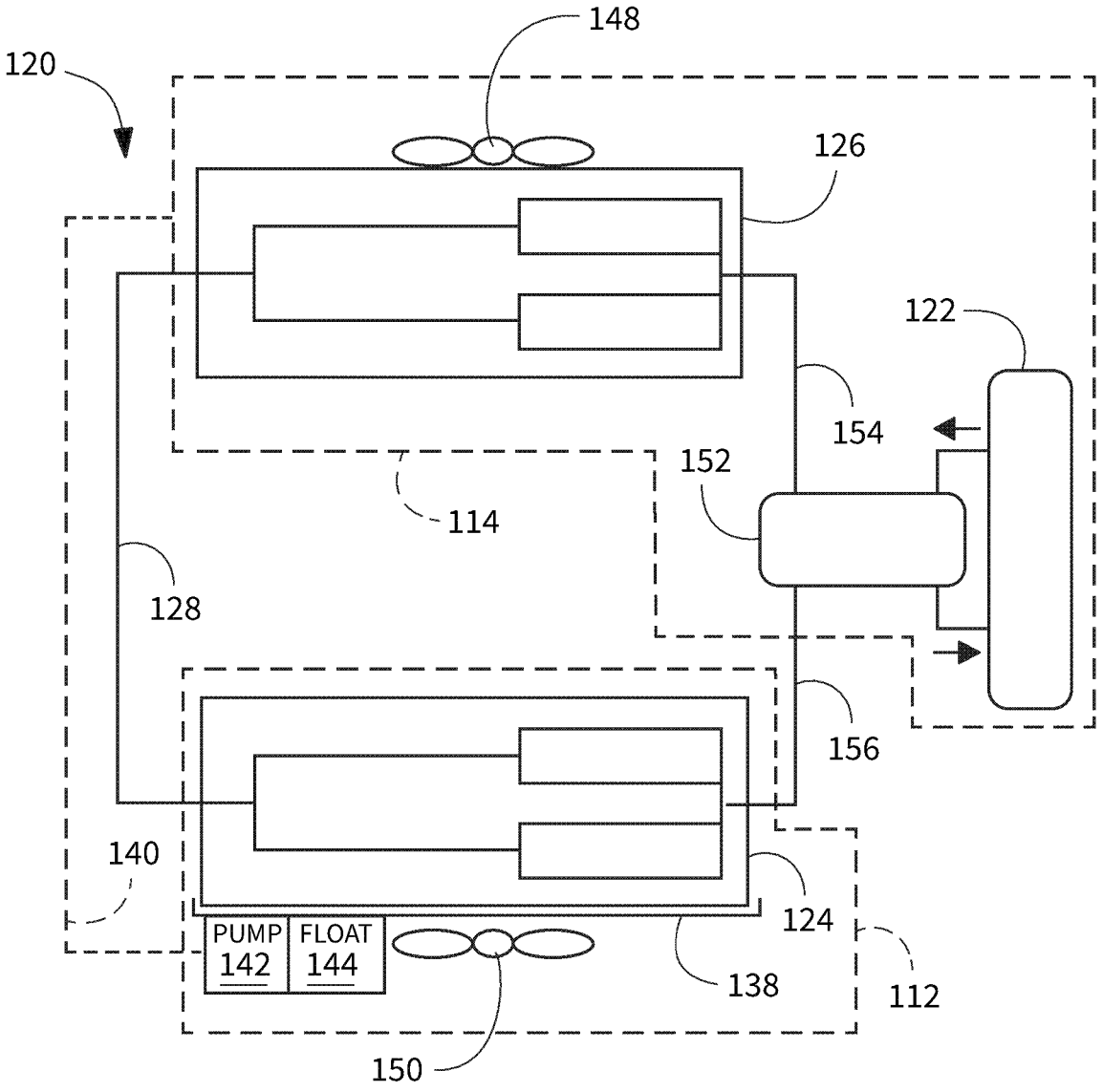
FIG. 3 is a schematic view of a sealed system of the example saddle window air conditioner of FIG. 1.

Turning to FIG. 3, sealed system 120 is disposed or positioned within casing assembly 110, and sealed system 120 includes components for transferring heat between the exterior atmosphere and the interior atmosphere. In particular, various components of sealed system 120 are positioned within interior casing 112 while other components of sealed system 120 are positioned within exterior casing 114.

Saddle window air conditioner 100 further includes a controller (not shown) with user inputs, such as buttons, switches and/or dials. The controller regulates operation of saddle window air conditioner 100. Thus, the controller is in operative communication with various components of saddle window air conditioner 100, such as components of sealed system 120 and/or a temperature sensor, such as a thermistor or thermocouple, for measuring the temperature of the interior atmosphere. In particular, the controller may selectively activate sealed system 120 in order to chill or heat air within sealed system 120, e.g., in response to temperature measurements from the temperature sensor.

The controller includes memory and one or more processing devices such as microprocessors, CPUs or the like, such as general or special purpose microprocessors operable to execute programming instructions or micro-control code associated with operation of saddle window air conditioner 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 3, sealed system 120 may also include a reversing valve 152. Reversing valve 152 selectively directs compressed refrigerant from compressor 122 to either interior coil 124 or exterior coil 126. For example, in a cooling mode, reversing valve 152 is arranged or configured to direct compressed refrigerant from compressor 122 to exterior coil 126. Conversely, in a heating mode, reversing valve 152 is arranged or configured to direct compressed refrigerant from compressor 122 to interior coil 124. Thus, reversing valve 152 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 154 that extends between and fluidly connects reversing valve 152 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 156 that extends between and fluidly connects interior coil 124 and reversing valve 152. Within interior coil 124, the refrigerant from capillary tube 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 152 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

Interior coil 124 and interior fan 150 may be positioned within interior casing 112. Conversely, compressor 122, exterior coil 126, reversing valve 152 and exterior fan 148 may be positioned within exterior casing 114. In such a manner, certain noisy components of sealed system 120 may be spaced from the interior atmosphere, and saddle window air conditioner 100 may operate quietly. Various fluid passages, such as refrigerant conduits, liquid runoff conduits, etc., may extend through bridge 130 to fluidly connect components within interior and exterior casings 112, 114.

It should be understood that sealed system 120 described above is provided by way of example only. In alternative example embodiments, sealed system 120 may include any suitable components for heating and/or cooling air with a refrigerant. Sealed system 120 may also have any suitable arrangement or configuration of components for heating and/or cooling air with a refrigerant in alternative example embodiments.

As shown in FIG. 3, saddle window air conditioner 100 also includes a drain pan or bottom tray 138. Components of sealed system 120 within interior casing 112 are positioned on bottom tray 138. Thus, liquid runoff from components of sealed system 120 within interior casing 112 may flow into and collect within bottom tray 138. In particular, interior coil 124 may be positioned over bottom tray 138 along the vertical direction, and liquid runoff from interior coil 124, e.g., generated during a defrost of interior coil 124, may flow downwardly from interior coil 124 into bottom tray 138. Thus, bottom tray 138 may collect defrost melt water from interior coil 124 within interior casing 112. As discussed in greater detail below, saddle window air conditioner 100 also includes features for flowing the liquid runoff in bottom tray 138 out of interior casing 112, e.g., and to exterior casing 114.

As shown in FIG. 3, saddle window air conditioner 100 may also include a pump 142 and a float switch 144. Pump 142 is coupled to condensate tube 140 and is operable to flow the liquid runoff from interior coil 124 within bottom tray 138 to exterior casing 114 through condensate tube 140. Float switch 144 is coupled to pump 142 and is operable to activate/deactivate pump 142 in response to a fill level of liquid runoff from interior coil 124. For example, float switch 144 may be positioned within bottom tray 138, and liquid runoff from interior coil 124 may flow into bottom tray 138 with float switch 144. As bottom tray 138 fills with liquid runoff from interior coil 124, float switch 144 trips and activates pump 142 when bottom tray 138 is filled with a predetermined fill level of liquid runoff. In such a manner, liquid runoff from interior coil 124 may be evacuated from bottom tray 138 by pump 142 when triggered by float switch 144.

Figure 4:
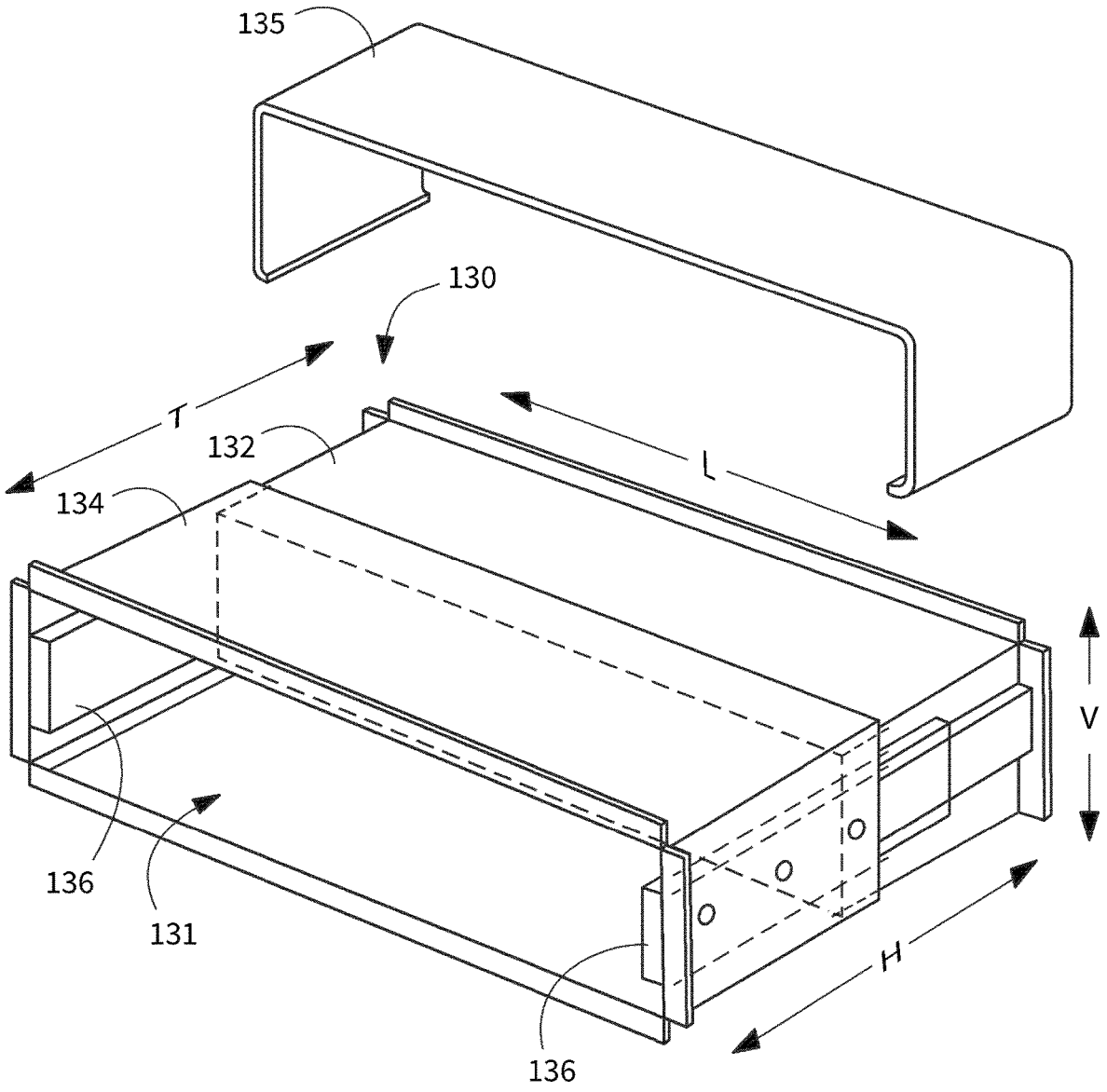
FIG. 4 is a perspective view of a bridge of the example saddle window air conditioner of FIG. 1.
Figure 5:
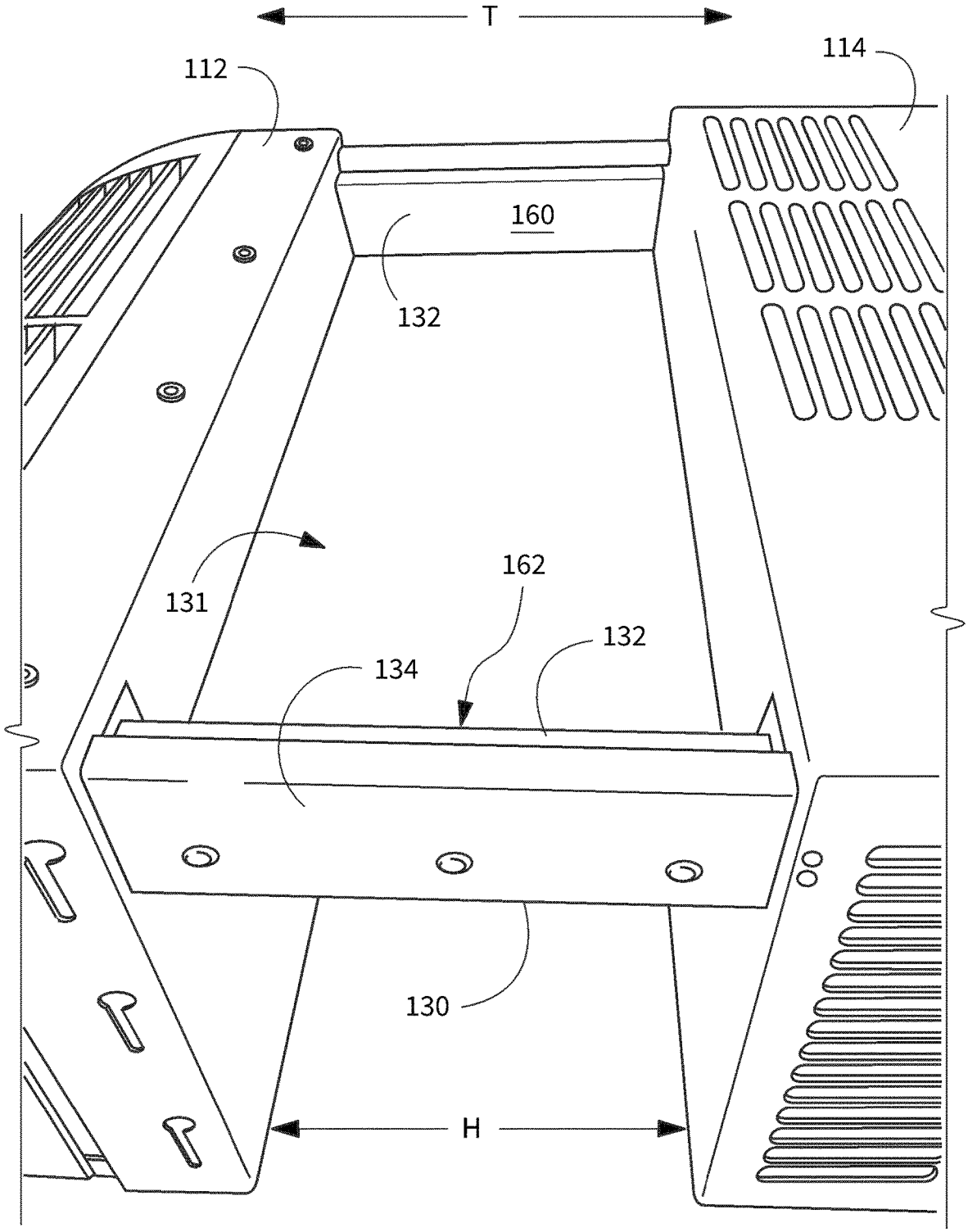
FIG. 5 is a partial, perspective view of the example saddle window air conditioner of FIG. 1 with the bridge shown in a retracted configuration.
Figure 6:
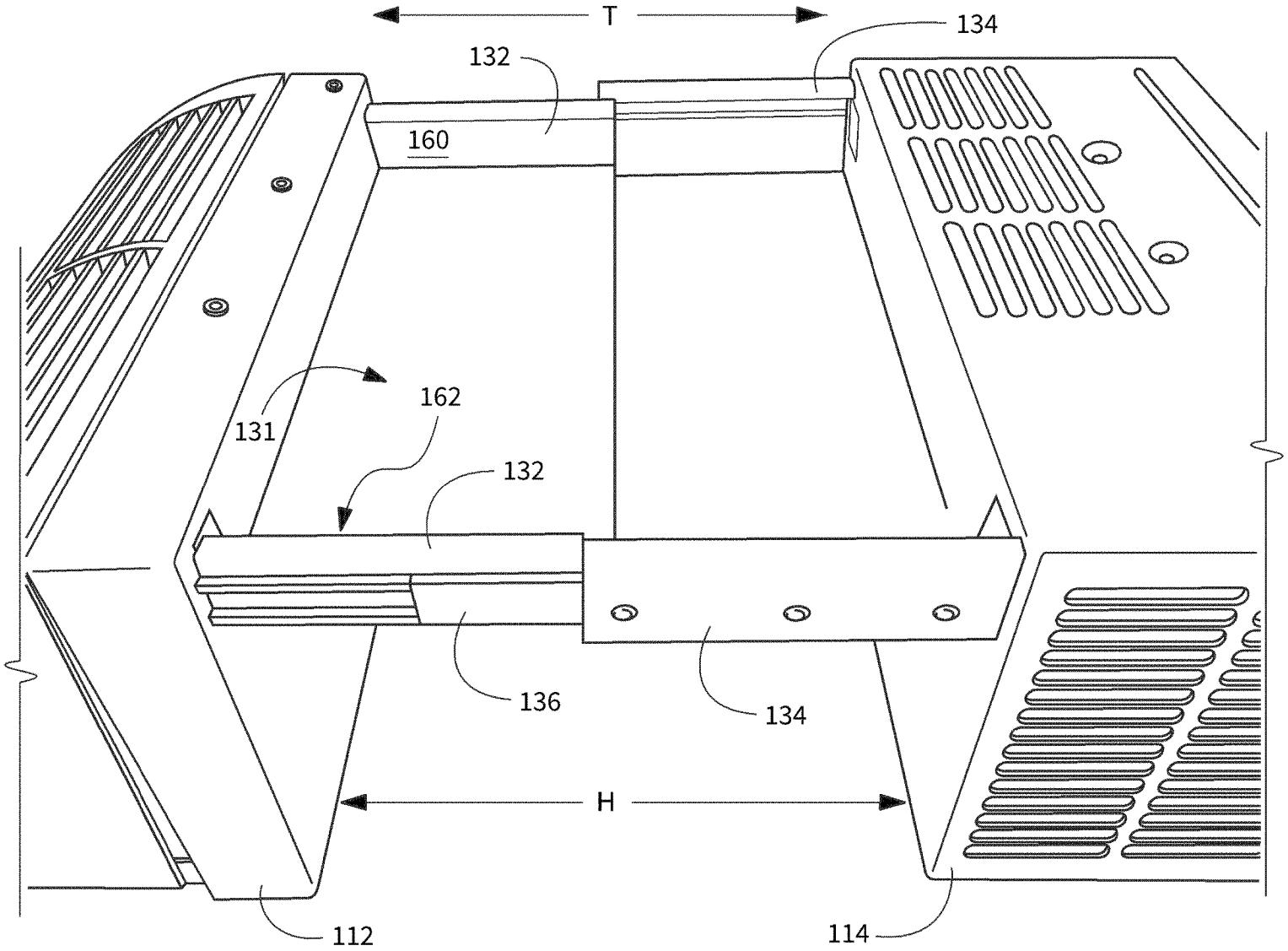
FIG. 6 is a partial, perspective view of the example saddle window air conditioner of FIG. 1 with the bridge shown in an extended configuration.

FIG. 4 is a perspective view of bridge 130. FIG. 5 is a partial, perspective view of saddle window air conditioner 100 with bridge 130 shown in a retracted configuration, and FIG. 6 is a partial, perspective view of saddle window air conditioner 100 with bridge 130 shown in an extended configuration. As discussed in greater detail below, bridge 130 may be adjusted to any suitable configuration between the retracted configuration (FIG. 5) and the extended configuration (FIG. 6) in order to fit saddle window air conditioner 100 onto windows with varying widths.

As may be seen in FIG. 4, bridge 130 includes a first sleeve 132 and a second sleeve 134. First sleeve 132 is mountable to one of interior casing 112 and exterior casing 114, and second sleeve 134 is mountable to the other of interior casing 112 and exterior casing 114. For example, as shown in FIG. 1, first sleeve 132 may be mounted to interior casing 112 such that first sleeve 132 is fixed relative to interior casing 112 and first sleeve 132 projects from interior casing 112 along the transverse direction T, and second sleeve 134 may be mounted to exterior casing 114 such that second sleeve 134 is fixed relative to exterior casing 114 and second sleeve 134 projects from exterior casing 114 along the transverse direction T.

First sleeve 132 is slidably received within second sleeve 134. For example, first sleeve 132 may be slidable within second sleeve 134 along the transverse direction T. In such a manner, a length H of bridge 130 (e.g., along the transverse direction T) between interior and exterior casings 112, 114 is adjustable by sliding first sleeve 132 within second sleeve 134. As an example, all or most of first sleeve 132 may be positioned within second sleeve 134 when bridge 130 is in the retracted configuration (FIG. 5). Thus, the length H of bridge 130 is relatively short in the retracted configuration of bridge 130 such that interior casing 112 is positioned relatively close to exterior casing 114. As an example, the length H of bridge 130 may be about eight inches (8") in the retracted configuration of bridge 130. Conversely, all or most of first sleeve 132 may be positioned outside of second sleeve 134 when bridge 130 is in the extended configuration (FIG. 6). Thus, the length H of bridge 130 is relatively long in the extended configuration of bridge 130 such that interior casing 112 is positioned relatively far from exterior casing 114. As an example, the length H of bridge 130 may be about fifteen inches (15") in the extended configuration of bridge 130. By adjusting the spacing between interior and exterior casings 112, 114 via bridge 130, saddle window air conditioner 100 may be securely installed in windows and walls with varying thicknesses. As used herein the term "about" means within two inches (2") of the stated length when used in the context of lengths.

Bridge 130 may also include one or more slide rails 136 for slidably mounting first sleeve 132 to second sleeve 134. In certain example embodiments, slide rails 136 include two slide rails 136 positioned within bridge 130, and each of the two slide rails 136 is positioned at a respective side of bridge 130 along the lateral direction L. Slide rails 136 may include ball bearings for facilitating sliding of first and second sleeves 132, 134 on slide rails 136. Slide rails 136 may advantageously constrain relative motion between first and second sleeves 132, 134 to along the transverse direction T and may thus block or limit relative motion between first and second sleeves 132, 134 to along the lateral and vertical directions L, T. A cover 135 may snap onto first and second sleeves 132, 134 to cover slide rails 136.

Figure 7:
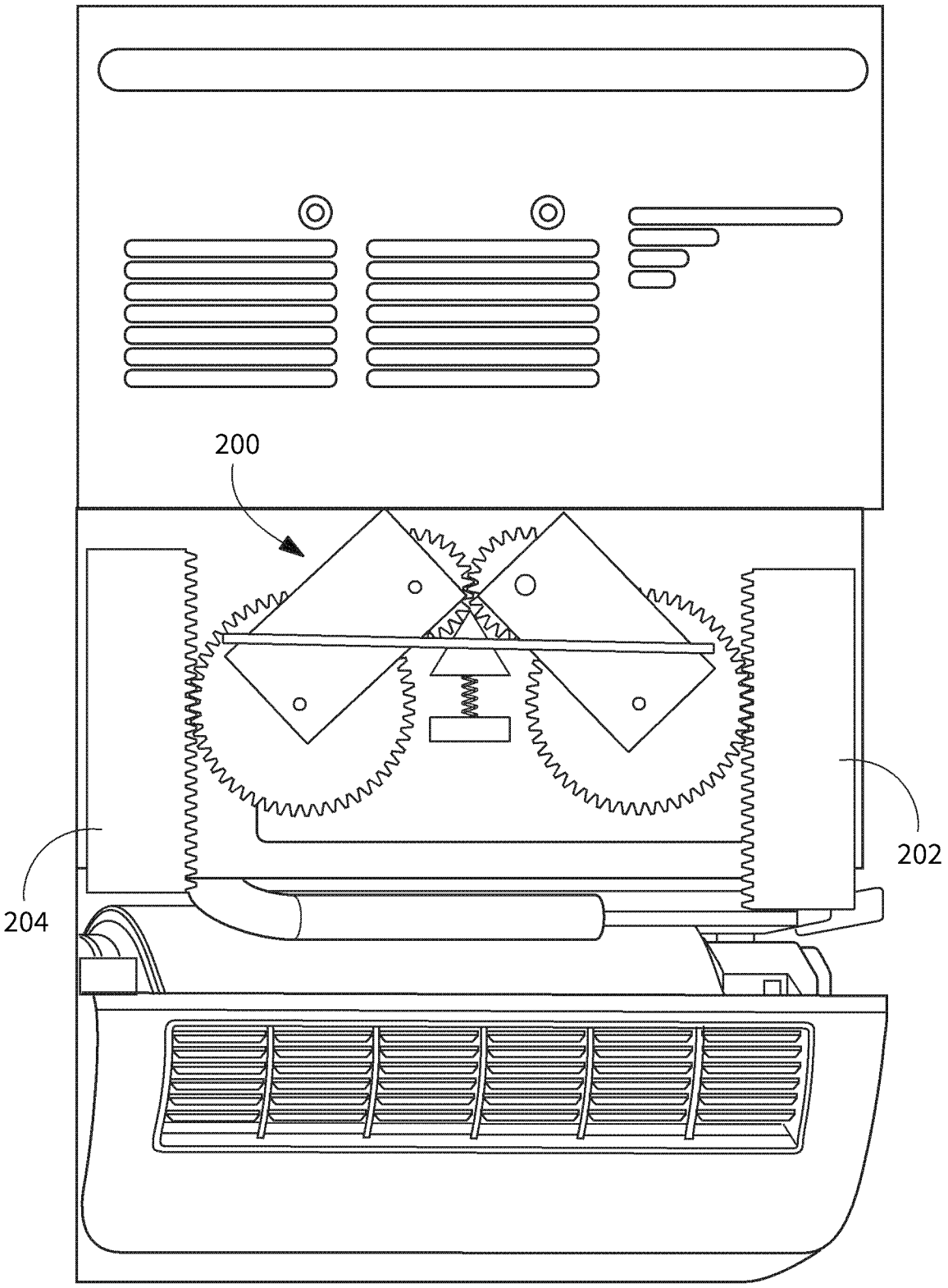
FIG. 7 provides a top-down view of a gear assembly which may be incorporated into of the example saddle window air conditioner of FIG. 1

Turning now to FIG. 7, the first sleeve 132 may be slidable within the second sleeve 134 by rotating a gear assembly 200. As may be seen in FIG. 7, the gear assembly 200 may include a first rack 202 and a second rack 204 which are mounted opposite one another within the first sleeve 132. For example, the first rack 202 may be mounted on, e.g., fixed to, a first inner surface 160 (FIGS. 5 and 6) of the first sleeve 132 and the second rack 204 may be mounted on, e.g., fixed to, a second inner surface 162 (FIGS. 5 and 6) of the first sleeve 132, whereby the first rack 202 and the second rack 204 are positioned within the first sleeve 132 and facing each other. In such embodiments, the second inner surface 162 may be opposite the first inner surface 160 and the first rack 202 may face the second rack 204. Thus, the gear assembly 200 may be configured to engage the first rack 202 and the second rack 204 to slide the first sleeve 132 within the second sleeve 134 when the gear assembly 200 rotates. For example, rotation of the gear assembly 200, and in particular of outer gears 206 and 208 thereof, may be translated into linear motion when the gear assembly 200 is engaged with the first rack 202 and the second rack 204.

Figure 8:
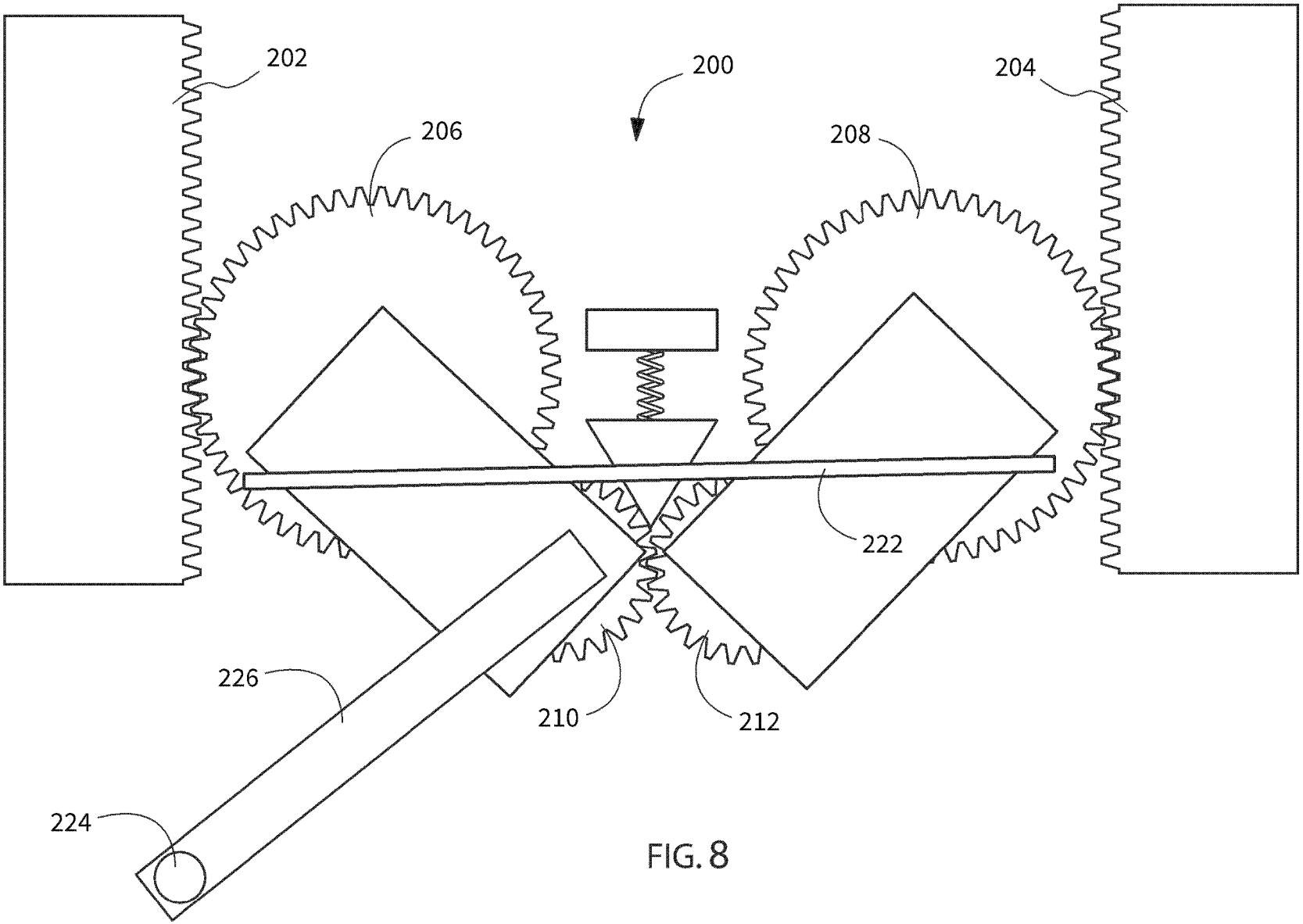
FIG. 8 provides a top-down view of the gear assembly of FIG. 7 with a handle and knob attached to the gear assembly.

As may be seen in FIG. 8, the gear assembly 200 may include a first inner gear 210 and a second inner gear 212. A handle 226 with a knob 224 formed thereon may be selectively mountable to one of the first inner gear 210 and the second inner gear 212, such as the handle 226 may be removably attached to one of the first inner gear 210 and the second inner gear 212, e.g., by inserting or removing the handle 226 along the vertical direction V. When the handle 226 is attached to one of the first inner gear 210 and the second inner gear 212, turning the handle 226 about the vertical direction V may cause the one of the first inner gear 210 and the second inner gear 212 to which the handle 226 is attached to also rotate, and the first and second inner gears 210 and 212 may be mutually engaged, whereby rotation of the one of the first inner gear 210 and the second inner gear 212 is transferred to the other of the first inner gear 210 and the second inner gear 212. It is to be understood that as used herein, gears are engaged when the teeth on each of the gears are enmeshed with the teeth on the other gear, whereby rotation of one gear also drives rotation of the other gear with which the one gear is engaged, as is recognized by those of ordinary skill in the art.

Figure 9:
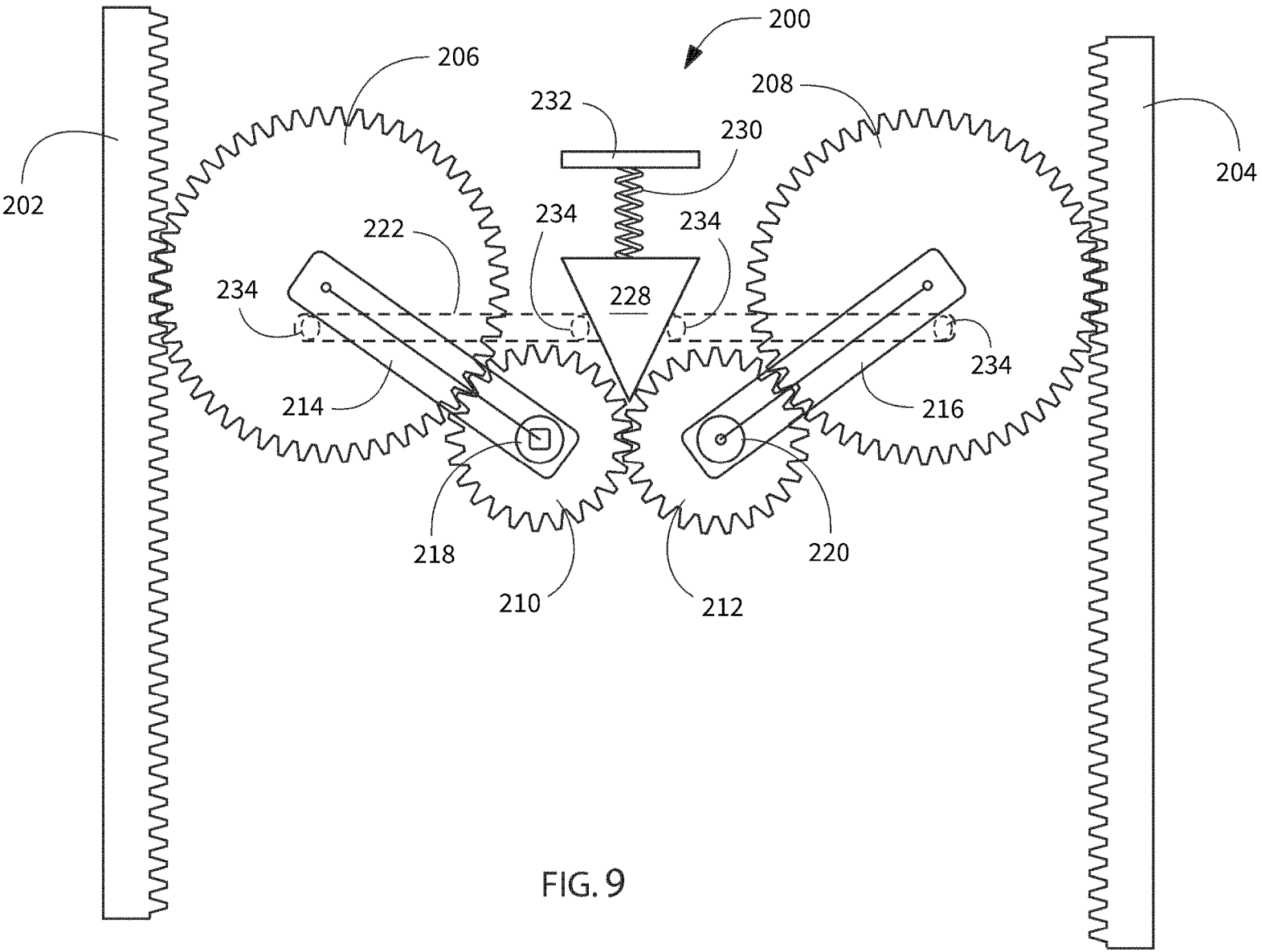
FIG. 9 provides a top-down view of the gear assembly of FIG. 7 with a clutch rod mounted to the gear assembly.

Turning now to FIG. 9, the first inner gear 210 may be coupled to a first outer gear 206 by a first link bar 214. The first inner gear 210 may also be engaged with the first outer gear 206. The second inner gear 212 may be coupled to a second outer gear 208 by a second link bar 216. The second inner gear 212 may also be engaged with the second outer gear 208. Thus, when the first and second inner gears 210 and 212 rotate as described above, such rotation also drives the first and second outer gears 206 and 208 to rotate, and, when the first and second outer gears 206 and 208 are engaged with the first and second racks 202 and 204 (e.g., as noted above, when teeth of each outer gear are enmeshed with teeth of each rack 202 and 204), the rotation of the first and second outer gears 206 and 208 is translated into linear motion, e.g., sliding of the first sleeve 132. For example, such rotation of the gear assembly 200 and translation thereof into linear motion may drive the first sleeve 132 towards the exterior casing 114 to retract or contract the bridge 130 (in embodiments such as the illustrated example embodiments where the first sleeve 132 is mounted to the interior casing 112, or, in additional embodiments, when the first sleeve 132 is mounted to the exterior casing 114, the first sleeve 132 may slide within the second sleeve 134 towards the interior casing 112 when the gear assembly is rotated in the engaged configuration to contract the bridge 130).

As may be seen in FIG. 9, the gear assembly 200 may include a stop wedge 228 which is biased against one or more gears of the gear assembly 200, such as biased against the first inner gear 210 and the second inner gear 212, whereby the stop wedge 228 restricts rotation of the gear assembly 200 in a first direction. For example, the rotation of the gear assembly 200 described above which contracts the bridge 130 may be in a second direction opposite the first direction, and the stop wedge 228 may prevent or limit the gear assembly 200 from rotating in the first direction and thereby prevent or limit extension of the bridge 130. A clutch rod 222 may also be provided, e.g., the clutch rod 222 may be selectively mountable to the gear assembly 200, e.g., above and between the stop wedge 228 and the gears 206, 208, 210, and 212. Also as may be seen in FIG. 9, the clutch rod 222 may include a plurality of feet 234 extending downward from the remainder of the clutch rod 222 when the clutch rod 222 is mounted on the gear assembly 200 (the clutch rod 222 is illustrated in dashed lines in FIG. 9 as if it were transparent in order to depict the feet 234 underneath the remainder of the clutch rod 222). The stop wedge 228 may be biased towards the first and second inner gears 210 and 212 by a linear biasing element 230 mounted to a base 232, such that the linear biasing element 230 urges the stop wedge 228 towards the first and second inner gears 210 and 212 and away from the base 232 along a generally straight line path. Travel of the stop wedge 228 towards the first and second inner gears 210 and 212 may be limited by the clutch rod 222, such as by one or more of the feet 234 thereof. Thus, the stop wedge 228 may be positioned, and held in position by the linear biasing element 230 and clutch rod 222, to only inhibit rotation of the gears of the gear assembly 200 in one direction, e.g., in the first direction as described. The linear biasing element 230 may be any suitable biasing element for urging the stop wedge 228 generally along a linear path, such as a coil spring as illustrated.

Figure 10:
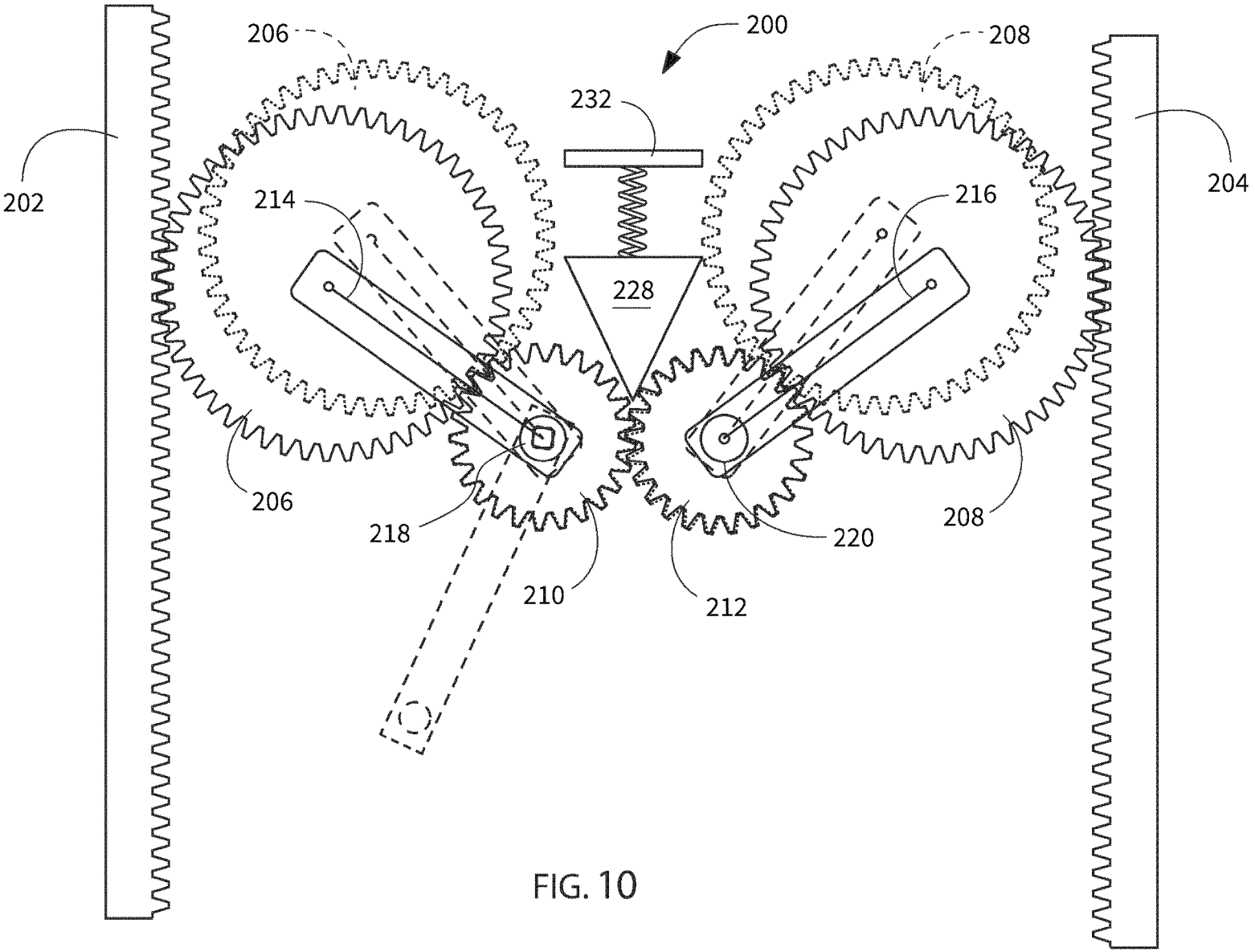
FIG. 10 provides a top-down view of the gear assembly of FIG. 7 in an engaged position and a disengaged position.

As may be seen in to FIG. 10, the gear assembly 200, and in particular the first and second outer gears 206 and 208 thereof, may be movable between an engaged configuration or position (solid lines in FIG. 10) and a disengaged configuration or position (dashed lines in FIG. 10). For example, the first and second outer gears 206 and 208 may each move around, or orbit, the respective one of the first and second inner gears 210 and 212, e.g., the first outer gear 206 may at least partially orbit the first inner gear 210 and the second outer gear 208 may at least partially orbit the second inner gear 212. The first and second outer gears 206 and 208 may only partially orbit the first and second inner gears 210 and 212, such as through an arc of about ninety degrees or less. For example, the first inner gear 2210 may be fixed to one of the first sleeve 132 and the second sleeve 134, and the second inner gear 212 may be fixed to the one of the first sleeve 132 and the second sleeve 134. In such embodiments, the first outer gear 206 may at least partially orbit the first inner gear 210, and the second outer gear 208 may at least partially orbit the second inner gear 212, e.g., between the engaged position and the disengaged position. In such embodiments, where the first inner gear 210 and the second inner gear 212 are fixed to the one of the first sleeve 132 and the second sleeve 134, the first and second racks 202 and 204 may be fixed to the other of the first sleeve 132 and the second sleeve 134.

The first and second outer gears 206 and 208 may be biased into engagement with the first and second racks 202 and 204. For example, as illustrated in FIGS. 9 and 10, a first torsional biasing element 218 may be coupled to the first inner gear 210, such as directly coupled to the first inner gear 210 and thereby connected to the first outer gear 206 via the link bar 214. A second torsional biasing element 220 may be connected to the second outer gear 208, e.g., directly coupled to the first inner gear 212 and connected to the second outer gear 208 via the second link bar 216. The first and second torsional biasing elements 218 and 220 may be any suitable biasing element for rotational or torsional urging of the first and second outer gears 206 and 208 towards the first and second racks 202 and 204, such as a spiral spring.

As shown in FIG. 10, when the clutch rod 222 is removed from the gear assembly 200, the gear assembly 200 may then move to the disengaged position. For example, the wedge 228 may, when not constrained by the clutch rod 222, be biased into the first and second inner gears 210 and 212, thereby urging the first and second inner gears 210 and 212, as well as the first and second outer gears 206 and 208 coupled to the first and second inner gears 210 and 212 via the first and second link bars 214 and 216, into the disengaged position. For example, the wedge 228 may cause the first and second inner gears 210 and 212 to rotate towards each other as the wedge 228 is pushed by the linear biasing element 230, whereby the first and second outer gears 206 and 208 are rotated around the first and second inner gears 210 and 212 to the disengaged position, e.g., the first and second outer gears 206 and 208 rotate towards each other, and the first outer gear 206 moves away from the first rack 202 while the second outer gear 208 moves away from the second rack 204. When the gear assembly 200 is thusly disengaged, the first sleeve 132 may slide freely within the inner sleeve 134, such as to permit adjustment of the length of the bridge 130, e.g., by pulling apart the interior casing 112 and the exterior casing 114 to lengthen or extend the bridge 130. After such adjustment, e.g., extension, of the bridge 130, the clutch rod 222 may be replaced on the gear assembly 200 to return the gear assembly 200 to the engaged position, e.g., to move the stop wedge 228 away from the first and second inner gears 210 and 212, whereby the first and second torsional biasing elements 218 and 220 will urge the first and second outer gears 206 and 208 (via the inner gears 210 and 212 and the link rods 214 and 216) into engagement with the first and second racks 202 and 204.

Thus, a user may shorten the length of the bridge 130 by either pushing the interior and exterior casings 112 and 114 towards each other or by rotating the knob 224 (FIG. 8). When the user pushes the interior and exterior casings 112 and 114 towards each other, the first and second outer gears 206 and 208 may break away from the racks 202 and 204 by the pushing force, e.g., the first and second torsional biasing elements 218 and 220 may be overcome by the pushing force, thereby permitting the first and second outer gears 206 and 208 to move to the disengaged position when the user pushes the interior and exterior casings 112 and 114 towards each other. When the user rotates the knob 224, the first and second inner gears 210 and 212 will rotate, and such rotation drives the first and second outer gears 206 and 208 to orbit partially around the first and second outer gears 210 and 212 such that the first and second outer gears 206 and 208 engage or re-engage the first and second racks 202 and 204. At the same time, the first and second outer gears 206 and 208 rotate (e.g., each outer gear revolves about a vertical axis extending through the center point thereof), and such rotation drives the first and second racks 202 and 204 to move, e.g., and thusly slide the first sleeve 132 within the second sleeve 134 to contract the bridge 130.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A saddle window air conditioner, comprising:

an interior casing;

an exterior casing spaced from the interior casing;

a bridge extending between the interior casing and the exterior casing, the bridge comprising a first sleeve mounted to one of the interior casing and the exterior casing and a second sleeve mounted to the other of the interior casing and the exterior casing, the first sleeve slidably received within the second sleeve, whereby a length of the bridge between the interior casing and the exterior casing is adjustable by sliding the first sleeve within the second sleeve; and a gear assembly mounted within the bridge, whereby the first sleeve is slidable within the second sleeve by rotating the gear assembly.

2. The saddle window air conditioner of claim 1, further comprising a first rack mounted on a first inner surface of the first sleeve and a second rack mounted on a second inner surface of the first sleeve, the second inner surface opposite the first inner surface and the first rack facing the second rack, wherein the gear assembly is configured to engage the first rack and the second rack to slide the first sleeve within the second sleeve when the gear assembly rotates.

3. The saddle window air conditioner of claim 2, wherein the first rack is fixed on the first inner surface of the first sleeve and the second rack is fixed on the second inner surface of the first sleeve.

4. The saddle window air conditioner of claim 2, wherein the gear assembly comprises a first inner gear fixed to one of the first sleeve and the second sleeve, a first outer gear which at least partially orbits the first inner gear, a second inner gear fixed to the one of the first sleeve and the second sleeve, and a second outer gear which at least partially orbits the second inner gear.

5. The saddle window air conditioner of claim 4, wherein the gear assembly further comprises a first biasing element coupled to the first outer gear and a second biasing element coupled to the second outer gear, the first biasing element configured to bias the first outer gear into engagement with the first rack and the second biasing element configured to bias the second outer gear into engagement with the second rack.

6. The saddle window air conditioner of claim 1, further comprising a clutch rod selectively mountable to the gear assembly.

7. The saddle window air conditioner of claim 1, further comprising a knob, the knob selectively coupled to the gear assembly, whereby the knob transfers rotation of the knob to the gear assembly when the knob is coupled to the gear assembly.

8. The saddle window air conditioner of claim 1, further comprising a stop wedge, the stop wedge biased against one or more gears of the gear assembly whereby the stop wedge restricts rotation of the gear assembly in a first direction.

9. The saddle window air conditioner of claim 1, wherein the gear assembly comprises a first gear fixed to one of the first sleeve and the second sleeve and a second gear which at least partially orbits the first gear.

10. The saddle window air conditioner of claim 9, wherein the first gear and the second gear are coupled by a link bar.

11. A saddle window air conditioner, comprising:

an interior casing;

an exterior casing spaced from the interior casing;

a bridge extending between the interior casing and the exterior casing, the bridge comprising a first sleeve mounted to one of the interior casing and the exterior casing and a second sleeve mounted to the other of the interior casing and the exterior casing, the first sleeve slidably received within the second sleeve, whereby a length of the bridge between the interior casing and the exterior casing is adjustable by sliding the first sleeve within the second sleeve; and a gear assembly coupled to the bridge, whereby the first sleeve is slidable within the second sleeve by rotating the gear assembly.

12. The saddle window air conditioner of claim 11, further comprising a first rack mounted to one of the first sleeve and the second sleeve a second rack mounted to the one of the first sleeve and the second sleeve, wherein the gear assembly is configured to engage the first rack and the second rack to slide the first sleeve within the second sleeve when the gear assembly rotates.

13. The saddle window air conditioner of claim 12, wherein the first rack is fixed to the one of the first sleeve and the second sleeve and the second rack is fixed to the one of the first sleeve and the second sleeve.

14. The saddle window air conditioner of claim 12, wherein the first rack is mounted to the first sleeve, the second rack is mounted to the first sleeve, wherein the gear assembly comprises a first inner gear fixed to the second sleeve, a first outer gear which at least partially orbits the first inner gear, a second inner gear fixed to the second sleeve, and a second outer gear which at least partially orbits the second inner gear.

15. The saddle window air conditioner of claim 14, wherein the gear assembly further comprises a first biasing element coupled to the first outer gear and a second biasing element coupled to the second outer gear, the first biasing element configured to bias the first outer gear into engagement with the first rack and the second biasing element configured to bias the second outer gear into engagement with the second rack.

16. The saddle window air conditioner of claim 11, further comprising a clutch rod selectively mountable to the gear assembly.

17. The saddle window air conditioner of claim 11, further comprising a knob, the knob selectively coupled to the gear assembly, whereby the knob transfers rotation of the knob to the gear assembly when the knob is coupled to the gear assembly.

18. The saddle window air conditioner of claim 11, further comprising a stop wedge, the stop wedge biased against the gear assembly whereby the stop wedge restricts rotation of the gear assembly in a first direction.

19. The saddle window air conditioner of claim 11, wherein the gear assembly comprises a first gear fixed to one of the first sleeve and the second sleeve and a second gear which at least partially orbits the first gear.

20. The saddle window air conditioner of claim 19, wherein the first gear and the second gear are coupled by a link bar.

* * * * *